United States Patent [19]

Newbold

[11] Patent Number: 5,062,407

[45] Date of Patent: Nov. 5, 1991

[54] ARROW REST AND ARROW LAUNCHER ADJUSTMENT APPARATUS

[75] Inventor: George T. Newbold, Walla Walla, Wash.

[73] Assignee: Martin Archery, Inc., Walla Walla, Wash.

[21] Appl. No.: 541,592

[22] Filed: Jun. 21, 1990

[51] Int. Cl.[5] ..... F41B 5/22

[52] U.S. Cl. ..... 124/44.5; 124/24.1

[58] Field of Search ..... 124/44.5, 24.1, 41.1

[56] References Cited

U.S. PATENT DOCUMENTS

| | | | |
|---|---|---|---|
| 3,108,584 | 10/1963 | Coe | 124/24.1 |
| 3,292,607 | 12/1966 | Hoyt, Jr. | 124/44.5 |
| 3,518,959 | 7/1970 | Bunker | 124/44.5 X |
| 3,828,757 | 6/1974 | Finlay | 124/44.5 |
| 4,476,846 | 10/1984 | Carville | 124/44.5 |
| 4,686,956 | 8/1987 | Troncoso, Jr. | 124/44.5 |
| 4,889,102 | 12/1989 | Martin | 124/88 |
| 4,899,716 | 2/1990 | Martin et al. | 124/41 |
| 4,924,841 | 5/1990 | Smith | 124/44.5 |
| 4,953,521 | 9/1990 | Troncoso et al. | 124/44.5 X |

OTHER PUBLICATIONS

Pore 'Ole Tom, "Target Sidewinder" Advertisement.

*Primary Examiner*—Peter M. Cuomo

*Attorney, Agent, or Firm*—Wells, St. John & Roberts

[57] ABSTRACT

An arrow launcher apparatus for adjusting an arrow launcher laterally along an elongated lateral support bar of an arrow rest apparatus, wherein the support bar has a male dovetail-shaped cross-section. The arrow launcher apparatus has an arrow launcher support block which supports an arrow launcher. A threaded bore extends generally laterally through the support block. A dovetail slot in the support block is slidaly received by the arrow rest lateral support bar and allows the support block to slide laterally relative to the support bar. A set screw is threadably received in the support block and is positioned to engage the arrow rest lateral support bar. The set screw can be tightened to lock the support block at a selected lateral position along the arrow rest lateral support bar. End blocks, each with dovetail slots, are received by the lateral support bar and are clamped to the support bar by set screws. Each end block has a lateral barrel at its fore end. A laterally elongated threaded rod is received through the end block barrels for slidable rotation therein. The threaded rod is thus mountable laterally along the arrow rest lateral support bar and is threadably received by the support block threaded bore. Rotation of the threaded rod when so mounted imparts lateral movement to the arrow launcher support block.

9 Claims, 3 Drawing Sheets

ARROW REST AND ARROW LAUNCHER ADJUSTMENT APPARATUS

TECHNICAL FIELD

This invention relates to arrow rests for archery bows.

BACKGROUND OF THE INVENTION

Arrow rests are typically attached to an archery bow for supporting an arrow before and during release. Many arrow rests allow lateral adjustment so that the arrow rest may be aligned with a drawn bowstring, and to adapt to the shooting and aiming styles of different archers. Many arrow rests as well allow for angular and fore/aft adjustments. It is desirable to make lateral adjustments without affecting these and other adjusting settings.

To provide such lateral adjustments, some popular arrow rests use a lateral support bar upon which an arrow launcher support block is slidably mounted. Such an arrow rest is shown in our U.S. Pat. No. 4,899,716 which is herein incorporated by reference. This type of structure allows the support block to slide laterally along the lateral support bar without changing other settings. An arrow launcher is typically attached to the support block to support an arrow. A set screw is used in the support block to engage the lateral support bar to secure the support block in a desired lateral position.

It would be desirable for an arrow rest design to provide finer lateral adjustments than those possible when simply sliding such a support block laterally by hand.

BRIEF DESCRIPTION OF THE DRAWINGS

Preferred embodiments of the invention are illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote he progress of science and useful arts" (Article 1, Section 8).

Figure 1:
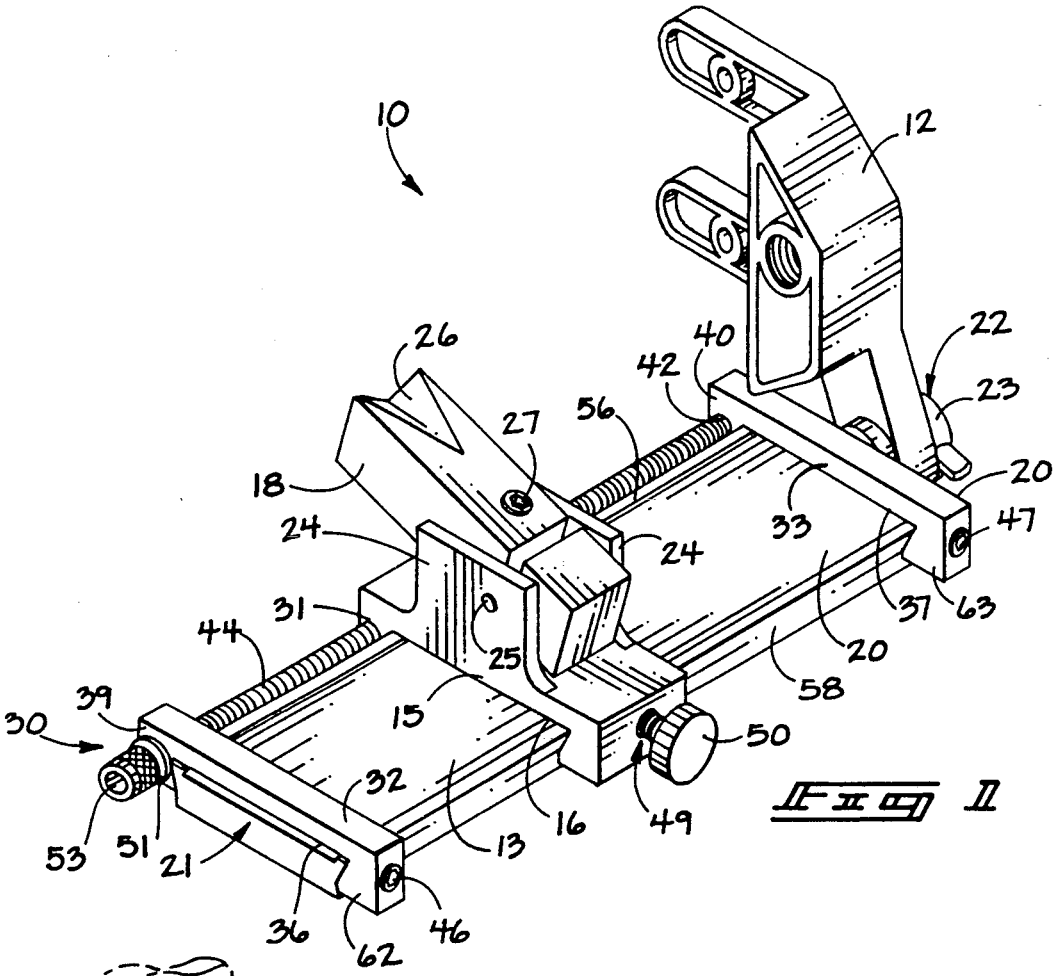
FIG. 1 is a left rear, downward perspective view of a preferred embodiment arrow rest apparatus in accordance with the invention.
Figure 2:
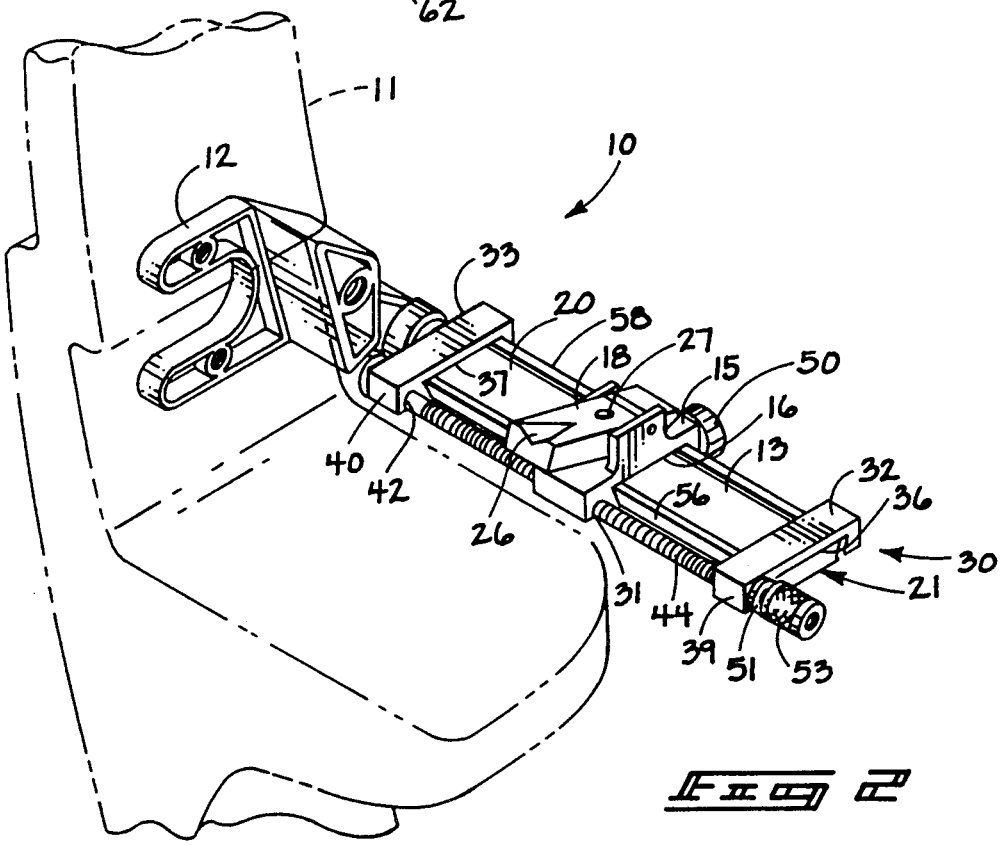
FIG. 2 is a left front, downward and reduced size perspective view of the arrow rest illustrated in FIG. 1, the arrow rest being mounted to an archery bow handle which is shown in phantom.
Figure 3:
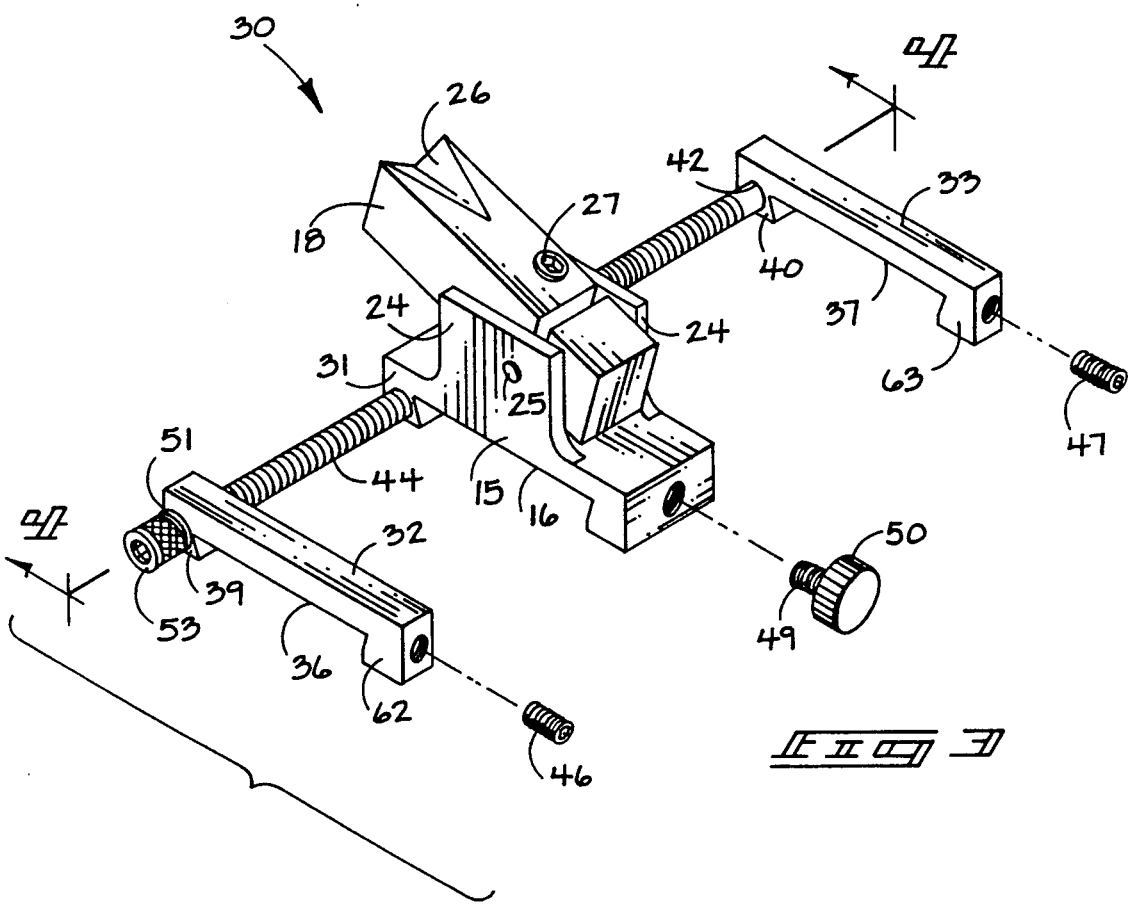
FIG. 3 is a left rear, downward perspective view of a preferred embodiment arrow launcher adjustment apparatus in accordance with the invention.

Referring first to FIGS. 1 and 2, an arrow rest apparatus for mounting to an archery bow is indicated generally by reference numeral 10. Arrow rest apparatus 10 includes an elongated lateral guide or support bar 13 which is attached to an arrow rest apparatus mounting bracket 12. Mounting bracket 12 is specifically used to attach arrow rest apparatus 10 to an archery bow handle 11 (FIG. 2) having opposed recessed mounting slots (not shown). Such a bow handle is described and illustrated in our U.S. Pat. No. 4,889,102, which is also herein incorporated by reference.

Lateral support bar 13 has a male dovetail-shaped lateral cross section, forming fore and aft edges 56 and 58 as well as opposed ends 20 and 21. Support bar 13 is mounted to bracket 12 and is angularly adjustable by means of a bolt assembly 22. Bolt assembly 22 extends through mounting bracket 12 and into a threaded hole formed in end 20 of lateral support bar 13. Bolt assembly 22 has a winged head 23 so that it can be easily tightened and loosened by hand. When bolt assembly 22 is loosened, it serves as a pivoting-like mount and allows an archer to quickly and easily adjust the angular position of support bar 13. Once support bar 13 has been adjusted, bolt assembly 22 may be tightened to lock support bar 13 in place.

Referring now to FIGS. 1–4, arrow rest apparatus 10 includes an arrow launcher adjustment apparatus 30. Apparatus 30 is used for adjusting an arrow launcher laterally upon elongated lateral support bar 13. Apparatus 30 comprises an arrow launcher carriage or support block 15 which is mountable to support bar 13. Block 15 has a female dovetail-shaped slot 16 which opens downwardly and is complimentary to the shape of support bar 13. Support block 15 is slidably mountable on lateral support bar 13 for lateral movement relative thereto, as is more fully described below.

Support block 15 has a pair of upwardly projecting sidewalls 24 and a pivot pin 25 extending therebetween. An arrow launcher 18 is pivotally received between sidewalls 24 by pivot pin 25. Its forward end is upwardly biased by a spring (not shown) whose tension is adjustable by means of a set screw 27. Arrow launcher 18 has a V-shaped notch 26 at its forward end for supporting and guiding an arrow before and during release. The construction of launcher 18 and its mounting relative to block 15 is shown, described and claimed in our U.S. Pat. No. 4,899,716.

A set screw 19 is threadably received in the aft end of support block 15 and is positioned to engage aft edge 58 of arrow rest lateral support bar 13. Set screw 49 is used to selectively lock support block 15 at a selected lateral position along arrow rest lateral support bar 13. Set screw 49 has an enlarged knurled head 50 to allow for easy loosening and tightening. Arrow launcher support block 15 also has a threaded bore 31 extending generally laterally therethrough adjacent its forward end.

Adjustment apparatus 30 includes end blocks 32 and 33 having dovetail slots 36 and 37 which are also complimentary to the shape of support bar 13. End blocks 32 and 33 each have fore and aft edge. Downward projections 39 and 40 are provided at their fore edges, and downward projections 62 and 63 are provided at their aft edges. Barrels or cylindrical openings 41 and 42 extend laterally through each downward projection 39 and 40.

End blocks 32 and 33 are suitably attached to lateral support bar 13. In FIGS. 1–4, set screws 46 and 47 are received transversely through aft projections 62 and 63 and clamp end blocks 32 and 33 to support bar 13. Set screws 46 and 47 also allow disassembly and removal of end blocks 32 and 33 and arrow launcher adjustment apparatus 30 from lateral support bar 13.

A laterally elongated threaded rod 44 is threadably received by support block threaded bore 31 and is rotatably mountable laterally along fore edge 56 of lateral support bar 13. In the illustrated embodiment, rod 44 is so mountable by being slidably received through barrels 41 and 42. In this manner, rod 44 threadably engages support block 15 yet is freely rotatable within openings 41 and 42.

Figure 4:
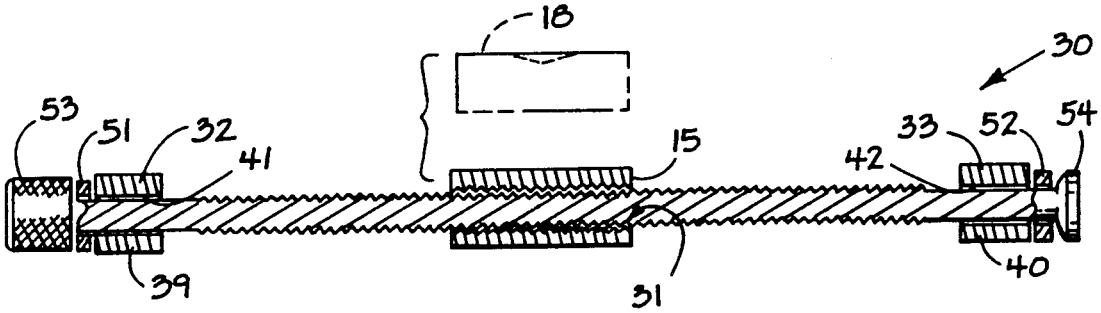
FIG. 4 is an enlarged cross-sectional view taken along line 4—4 in FIG. 3.

Threaded rod 44 has an inside end nearest bow 11, and an outside end away from bow 11 (FIG. 2). The outside and inside ends of threaded rod 44 extend through barrels 41 and 42 and protrude beyond end blocks 32 and 33. Retaining washers 51 and 52 are received about rod 44 adjacent its ends. An enlarged knurled knob 53 at the outside end of threaded rod 44 holds retaining washer 51 adjacent or against end block 32. An enlarged shoulder 54 at the inside end of threaded rod 44 holds retaining washer 52 adjacent or against end block 33 (FIG. 4). Thus, lateral movement of threaded rod 44 is limited by knurled knob 53, retaining washers 51 and 52, and enlarged shoulder 54, while barrels 41 and 42 allow free rotation of threaded rod 44.

To install arrow launcher adjustment apparatus 30 on elongated lateral support bar 13, end blocks 32 and 33 and support blocks 15 are slid over lateral support bar end 21. End blocks 32 and 33 are then clamped into position as shown using set screws 46 and 47 which engage aft edge 58 of support bar 13. Retaining washers 51 and 52 prevent lateral movement of threaded rod 44 when end blocks 32 and 33 are so mounted.

Arrow launcher 18 can be laterally adjusted by rotating knurled knob 53 to turn threaded rod 44 within threaded bore 31 of arrow launcher support block 15. This rotation causes lateral movement of support block 15 and allows for very fine lateral adjustments. Once a lateral position has been selected, support block 15 may be locked in place by engaging set screw 49 against aft edge 58 of support bar 13. To set launcher 18 to another position, set screw 49 is loosened, rod 44 rotated, and then set screw 49 reset. A position graph, such as shown in our application Ser. No. 07/520,282, could be used on the upper face of support bar 13 to enable quick determination of preset locations.

Figure 5:
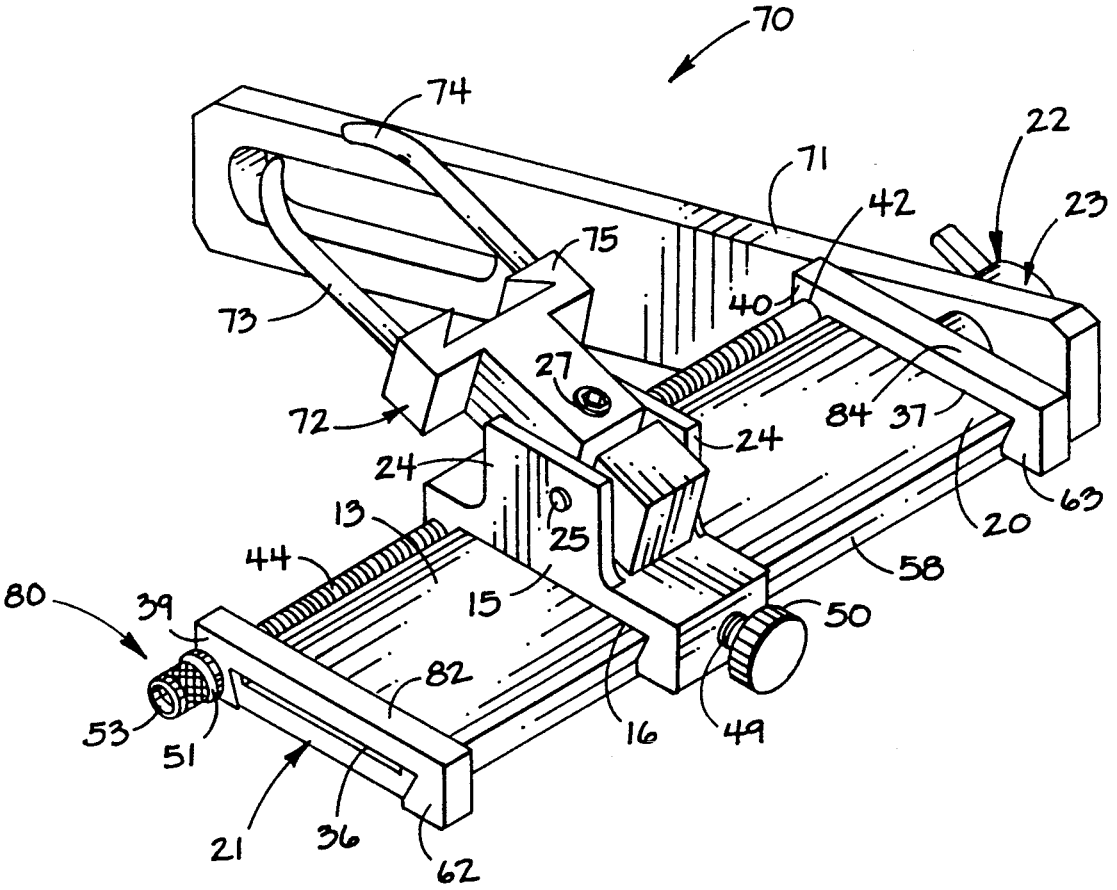
FIG. 5 is a left rear, downward perspective view of an alternate embodiment arrow rest apparatus in accordance with the invention.

FIG. 5 shows an alternate embodiment of an arrow rest apparatus and arrow rest adjustment apparatus which are generally indicated by references numeral 70 and 80, respectively. Components which are common to the FIGS. 1–4 and FIG. 5 embodiments are designated with like numerals. In arrow rest apparatus 70, an alternate mounting bracket 71 is used as is shown in our U.S. Pat. No. 4,899,716.

Arrow rest adjustment apparatus 80 has an alternate arrow launcher 72. It includes a modified arrow launcher base 75 which is mounted pivotally between sidewalls 24. A pair of prongs 73 and 74 are received by holes (not shown) in arrow launcher base 75, and are fixed in place with set screws (not shown) engaging from therebeneath. Pronge 73 and 74 extend upward and forward from arrow launcher base 75 to engage an arrow.

Arrow rest adjustment apparatus 80 also includes alternate end blocks 82 and 84. End blocks 82 and 84 are affixed to lateral support bar 13 with a suitable epoxy, rather than having threaded holes and set screws as do end blocks 32 and 33 of the FIGS. 1–4 embodiment.

The components herein described can be constructed from any suitable material, and are preferably fabricated using various metals (such as aluminum), plastics, and plastic-like materials.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart from the threaded rod for selectively locking the support block at a selected lateral position along the arrow rest lateral support bar; and a pair of end blocks removably mountable to the arrow rest lateral support bar, each end block having a barrel, the threaded rod being slidably received through the barrel for rotation therein.

2. An arrow rest apparatus for an archery bow incorporating the arrow launcher apparatus of claim 1.

3. The arrow launcher adjustment apparatus of claim 1 wherein the arrow rest lateral support bar to which the launcher apparatus is adapted to be mountable has a male dovetail-shaped lateral cross-section and each end block has a dovetail slot which is complimentary in shape to be received by the male dovetail-shaped lateral support bar.

4. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart from the threaded rod for selectively locking the support block at a selected lateral position along the arrow rest lateral support bar;

a pair of end blocks removably mountable to the arrow rest lateral support bar, each end block having a barrel, the threaded rod being slidably received through the barrel for rotation therein; and each end block being removably mountable to the arrow rest lateral support bar by means of a set screw to clamp each end block to the lateral support bar.

5. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart form the threaded rod for selectively locking the support block at a selected lateral position along the arrow rest lateral support bar;

a pair of end blocks removably mountable to the arrow rest lateral support bar, each end block having a barrel, the threaded rod being slidably received through the barrel for rotation therein;

the arrow rest lateral support bar to which the launcher apparatus is adapted to be mountable has a male dovetail-shaped lateral cross-section;

each end block has a dovetail slot which is complementary in shape to be received by the male dovetail-shaped lateral support bar; and each end block is removably mountable to the arrow rest lateral support bar, each end block having a set screw to removably clamp the end block to the lateral support bar.

6. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart from the threaded rod for selectively locking the support block at a selected lateral position along the arrow rest lateral support bar;

the lateral support bar of the arrow rest apparatus to which the launcher apparatus is adapted to be mountable having fore and aft edges;

the launcher apparatus comprising a pair of end blocks mountable to the lateral support bar, the end blocks having fore and aft edges, each end block having a projection with a barrel adjacent to its fore edge to rotatably retain the rod along the fore edge of the lateral support bar; and the locking means comprises a set screw threadably received in the arrow launcher support block to engage the aft edge of the arrow rest lateral support bar.

7. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart from the threaded rod for selectively locking the support block at a selected lateral position along the arrow rest lateral support bar;

the arrow rest lateral support bar to which the launcher is adapted to be mountable having a male dovetail-shaped cross-section, the arrow launcher adjustment apparatus further comprising a pair of end blocks each having a complementary dovetail slot to be received by the arrow rest lateral support bar, each end block having a projection with a barrel, the threaded rod being received through the barrels for rotation therein; and the locking means comprising a set screw threadably received in the arrow launcher support block to engage the arrow rest lateral support bar.

8. An arrow launcher adjustment apparatus for adjusting an arrow launcher laterally along an elongated lateral support bar of an arrow rest apparatus, the arrow launcher apparatus comprising:

an arrow launcher support block, the support block having a threaded bore extending generally laterally therethrough and being slidably mountable to the arrow rest lateral support bar for lateral movement relative thereto;

an arrow launcher supported by the support block;

a laterally elongated threaded rod threadably received by the support block threaded bore, the threaded rod being mountable laterally along the arrow rest lateral support bar for rotation relative to the support bar and support block, rotation of the threaded rod when so mounted imparting lateral movement to the support block;

locking means on the support block and apart from the threaded rod for selectively locking the support block at a selected lateral position along he arrow rest lateral support bar;

the arrow rest lateral support bar to which the launcher is adapted to be mountable having a male dovetail-shaped cross-section, the arrow launcher adjustment apparatus further comprising a pair of end blocks each having a complementary dovetail slot to be received by the arrow rest lateral support bar, each end block having a projection with a barrel, the threaded rod being received through the barrels for rotation therein;

the lateral support bar of the arrow rest apparatus to which the launcher apparatus is adapted to be mountable having fore and aft edges;

the launcher apparatus comprising a pair of end blocks mountable to the lateral support bar, the end blocks having fore and aft edges, each end block having a projection with a barrel adjacent to its fore edge to rotatably retain the rod along the fore edge of the lateral support bar, and the locking means comprises a set screw threadably received in the arrow launcher support block to engage the aft edge of the arrow rest lateral support bar.

9. An arrow launcher adjustment apparatus for adjusting an arrow launcher laterally along an elongated lateral support bar of an arrow rest apparatus, the elongated lateral support bar having a male dovetail-shaped cross-section, the arrow launcher apparatus comprising:

an arrow launcher support block, the support block having a threaded bore extending generally laterally therethrough and having a dovetail slot to slidably receive the arrow rest lateral support bar for lateral movement relative thereto;

a set screw threadably received in the support block, the set screw being position to engage the arrow rest lateral support bar to selectively lock the support block at a selected lateral position along the arrow rest lateral support bar;

an arrow launcher supported by the support block;

a laterally elongated threaded rod threadably received by the support block threaded bore, the threaded rod being rotatably mountable laterally along the arrow rest lateral support bar, rotation of the threaded rod when so mounted imparting lateral movement to the support block;

a pair of end blocks removably mountable to the arrow rest lateral support bar, each end block having a dovetail slot which is complimentary in shape to be received by the male dovetail-shaped lateral support bar, each end block having a barrel, the threaded rod being slidably received through the barrels for rotation therein; and a set screw in each end block removably clamp the end block to the arrow rest lateral support bar.

* * * * *